US005969641A

United States Patent [19]

Nakamura et al.

[11] Patent Number: 5,969,641

[45] Date of Patent: Oct. 19, 1999

[54] VEHICLE IDENTIFICATION SYSTEM FOR ELECTRIC TOLL COLLECTION SYSTEM

[75] Inventors: Yuki Nakamura; Yoshihiko Kuwahara, both of Tokyo, Japan

[73] Assignee: NEC Corporation, Tokyo, Japan

[21] Appl. No.: 08/827,692

[22] Filed: Apr. 10, 1997

[30] Foreign Application Priority Data

Apr. 15, 1996 [JP] Japan ..... 8-092765

[51] Int. Cl.[6] ..... G06G 1/00

[52] U.S. Cl. ..... 340/928; 235/384

[58] Field of Search ..... 235/384, 928

[56] References Cited

U.S. PATENT DOCUMENTS

| | | | |
|---|---|---|---|
| 3,924,236 | 12/1975 | Earp et al. . | |
| 4,057,803 | 11/1977 | Coleman . | |
| 5,404,144 | 4/1995 | Vlannes . | |
| 5,440,109 | 8/1995 | Hering et al. . | |
| 5,451,758 | 9/1995 | Jesadanont | 235/384 |
| 5,710,556 | 1/1998 | Nishimura et al. | 340/928 |

FOREIGN PATENT DOCUMENTS 0 715 185 A2 6/1996 European Pat. Off. .

OTHER PUBLICATIONS

European Search Report dated Jul. 30, 1997.

D. Boothroyd, "For Whom The Road Tolls", New Electronics, vol. 28, No. 20, Nov. 28, 1995, pp. 18–20.

Dieter Rittch, et al., Zukuenftige Automatische Gebuehrenerfassung Fuer Den, NTZ Nachrichtentechnische Zeitschrift, vol. 46, No. 4, Mar. 1, 1993, pp. 258–260, 262–265.

Charles H. Small, Credit–Card Sized Memories Small Memories Take On Wider Application, EDN Electrical Design News, vol. 36, No. 13, Jun. 20, 1991, pp. 67, 69–70.

*Primary Examiner*—Harold I. Pitts

*Attorney, Agent, or Firm*—Whitham, Curtis & Whitham

[57] ABSTRACT

A plurality of antennas receives radio wave transmitted from a vehicle which comes in a toll collection area. Each antenna has at least three antenna elements, and the antennas are disposed in the horizontal direction and vertical direction. The signal analyzer analyzes the ID signal included in the received radio wave to identify the vehicle. The direction detector measures the direction of arrival (DOA) of radio wave received by two antennas selected by the antenna selector by way of two-dimensional interferometry principle in terms of the directional angle and depression angle. The location detector calculates the location of the vehicle in the horizontal direction and the height in the vertical direction of the vehicle as a location information based on the DOA of the radio wave measured by the direction detector. The vehicle tracking unit generates the locus data of the vehicle based on the location information calculated by the location detector and the information for identifying the vehicle analyzed by the signal analyzer. On the other hand, the video camera takes a picture of the vehicle which comes in the toll collection area to obtain the picture data. The data correlation unit judges whether the vehicle is a violator vehicle by correlating the picture data and locus data. The controller registers the locus data and picture data of the vehicle if the vehicle is a violator vehicle. On the other hand, the controller collects a prescribed toll from the vehicle if the vehicle is not a violator vehicle.

19 Claims, 7 Drawing Sheets

VEHICLE IDENTIFICATION SYSTEM FOR ELECTRIC TOLL COLLECTION SYSTEM

BACKGROUND OF THE INVENTION

1. Field of the Invention

This invention relates to a vehicle identification system, and particularly relates to a vehicle identification system applicable to the electric toll collection (ETC) systems provided with a means for measuring the location of a vehicle by measuring direction of arrival (DOA) of radio wave transmitted from the vehicle.

2. Description of the Related Art

A conventional vehicle identification system to be applied to ETC systems for using on toll roads is disclosed in U.S. Pat. No. 5,440,109. In this conventional vehicle identification system, an infrared beacon (IRB) which is a component of an infrared communication system (IRK), an infrared video camera (IRV) which is a component of an infrared location measurement system, a traffic radar system (RD), and a usual video camera (NV) which is a component of a vehicle identification-recording system (FIR) are installed on a toll booth side. These systems are connected to a controller for performing a total data processing and correlative processing.

By way of the data fusion of three types of information obtained from these systems, namely radar information, IR location information, and video information, the identification of a vehicle under the communication for toll collection is performed.

However, in this conventional vehicle identification system, it is required to install an infrared communication system, and it results in high cost. The communication by way of infrared ray is not appropriate to a foggy environment, and therefore if this conventional vehicle identification system is used in a foggy place, it is apt to cause the erroneous detection of a vehicle and communication trouble between a toll booth and vehicles.

SUMMARY OF THE INVENTION

It is an object of the present invention to provide a vehicle identification system which is excellent in reliability and can be manufactured at a low cost.

It is another object of the present invention to provide a vehicle identification system which is capable of identifying individually a plurality of vehicles accurately regardless of overlapping of the plurality of vehicles disposed side by side in parallel.

To achieve the above-mentioned objects, the system for identifying a vehicle which comes in a prescribed area in accordance with the present invention is provided with a receiving means for receiving radio wave transmitted from the vehicle which comes in the prescribed area, an identification means for identifying the vehicle based on the ID signal included in said radio wave which is received by said receiving means, a directional finder for measuring the direction of arrival of the radio wave, and a location detection means for calculating the location of the vehicle based on the direction of arrival measured by the directional finder.

The vehicle identification system in accordance with the present invention is provided with a means for measuring the direction of arrival of radio wave transmitted from the vehicle which comes in the prescribed area by way of two dimensional interferometry principle in terms of the directional angle and depression angle.

The system for identifying the vehicle which comes in the toll collection area and for collecting a prescribed toll from the vehicle in accordance with the present invention is provided with a receiving means for receiving radio wave transmitted from a vehicle which comes in a toll collection area, an identification means for identifying the vehicle by analyzing the ID signal included in the received radio wave, a directional finder for measuring the direction of arrival of the radio wave, a location detection means for calculating the location of the vehicle based on the direction of arrival measured by the directional finder, a vehicle tracking means for calculating the locus of the vehicle based on the identification information of the vehicle outputted from the identification means and the location information of the vehicle outputted from the location detection means, a camera means for taking a picture of the vehicle and outputting a picture data, and a toll collection means for collecting a desired toll from the vehicle based on the locus data supplied from the vehicle tracking means and the picture data supplied from the camera means.

BRIEF DESCRIPTION OF THE DRAWINGS

The above and other objects, features and advantages of the present invention will become more apparent from the following detailed description taken with the accompanying drawings in which.

DETAILED DESCRIPTION OF PREFERRED EMBODIMENTS

Figure 1:
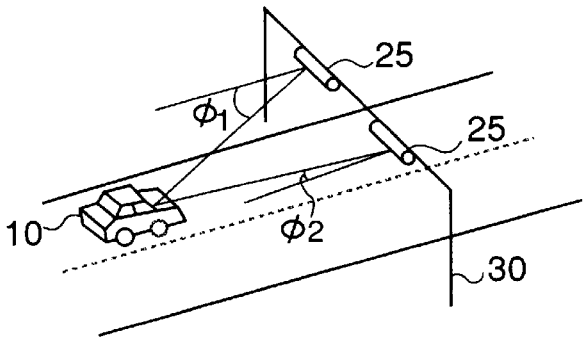
FIG. 1 is a perspective view for illustrating the structure of a vehicle identification system applying a one dimensional interferometry principle.

One embodiment of a vehicle identification system in accordance with the present invention will be described in detail referring to the drawings.

The vehicle identification system of the embodiment identifies vehicles applying two-dimensional interferometry principle.

Firstly, before the vehicle identification system applying the two-dimensional interferometry principle is explained, the method of measuring the location of the vehicle applying one-dimensional interferometry principle will be described referring to the FIGS. 1 and 2.

Figure 2:
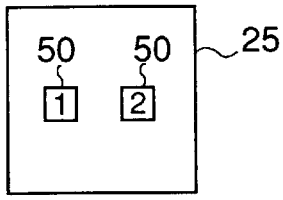
FIG. 2 is a diagram for illustrating an antenna shown in FIG. 1.
Figure 3A:
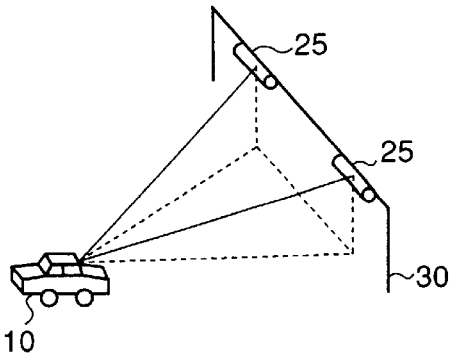
FIG. 3A is a perspective view for describing a method for detecting a vehicle applying the one dimensional interferometry principle.
Figure 3B:
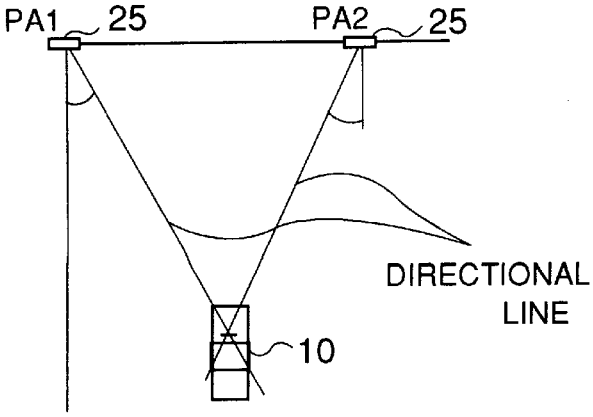
FIG. 3B is a plan view of FIG. 3A.

In FIG. 1, a plurality of antennas 25 of a directional finder is deployed horizontally on a gantry 30, and the antennas 25 receive radio waves transmitted from vehicles. The antenna 25 is an array antenna comprising at least two antenna elements 50. In the location measurement method by way of one dimensional interferometry principle, as shown in FIGS. 3A and 3B, directional lines 1 and 2 are drawn from the position of each antenna 25 based in the DOAs measured by way of the radio wave transmitted from a vehicle, and then the position of intersection of the two directional lines is determined as the location of the vehicle 10.

The position measurement method by way of one dimensional interferometry principle is described herein under in detail.

A plurality of antenna elements 50, the number of which are n (n=1,2, . . . ), are used. The element numbers (natural numbers from 1 to n) are assigned to each antenna element 50. A signal outputted from each antenna element 50 is referred to as X1, X2, X3, . . . , Xn wherein the numbers represent the element numbers respectively, and when antenna elements 50 are paired to form pairs, the phase difference $\psi_{ij}$ of each pair is represented by the following equation (1).

$$\phi_{ij} = \frac{X_i \overline{X_j^*}}{|\overline{X_i X_j^*}|} \tag{1}$$

Here, the symbol i and j in the equation (1) represent the element numbers assigned to each antenna element 50.

Previously, the theoretical value (or measured value) of signals received by each antenna element 50 is calculated (or measured) for all the directional angles $\phi$ in the predetermined range, and the theoretical values (or measured values) are stored in a memory device. The theoretical values (or measured values) are represented as A1($\phi$), A2($\phi$), A3($\phi$), . . . , An($\phi$) corresponding to the element numbers given to each antenna element 50.

Like the equation (1), the phase difference of each antenna element 50 pair is represented by the following equation (2).

$$A_{ij}(\phi) = \frac{A_i(\phi)\overline{A_j^*(\phi)}}{|\overline{A_i(\phi)A_j^*(\phi)}|} \tag{2}$$

The standard phase difference $A_{ij}(\phi)$ represented by the equation (2) is calculated previously for all the directional angles $\phi$. The directional angle $\phi$ at which the phase difference $\psi_{ij}$ represented by the equation (1) becomes nearest the standard phase difference $A_{ij}(\phi)$ represented by the equation (2) is obtained, and the obtained directional angle is estimated to be the direction of arrival (DOA). The least-square method is used for estimation of the DOA, and then the DOA $\phi$ at which the following equation (3) becomes the minimum is determined.

$$\sum_{ij}\left(\frac{\overline{X_i X_j^*}}{|\overline{X_i X_j^*}|} - \frac{\overline{A_i(\phi)A_j^*(\phi)}}{|\overline{A_i(\phi)A_j^*(\phi)}|}\right) \tag{3}$$

Next, a method for determining a vehicle location based on the DOA is described.

The DOA of the radio wave received by means of at least one pair of antennas 25 disposed horizontally on the gantry 30 as shown in FIG. 1 is determined by way of the above-mentioned one dimensional interferometry principle. Directional lines 1 and 2 are drawn from the position, where each antenna 25 is provided, based on the DOA of radio wave measured by means of each antenna 25 as shown in FIG. 3B. The intersection of the directional lines 1 and 2 drawn from each antenna 25 is detected as the location of the vehicle 10 which transmitted radio wave.

Figure 4A:
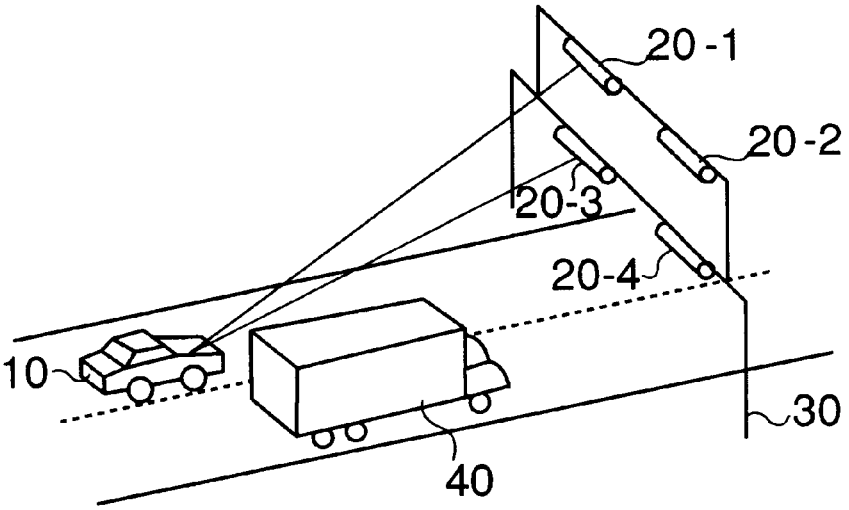
FIG. 4A is a perspective view for illustrating the structure of a vehicle identification system applying a two dimensional interferometry principle in accordance with the present invention.
Figure 4B:
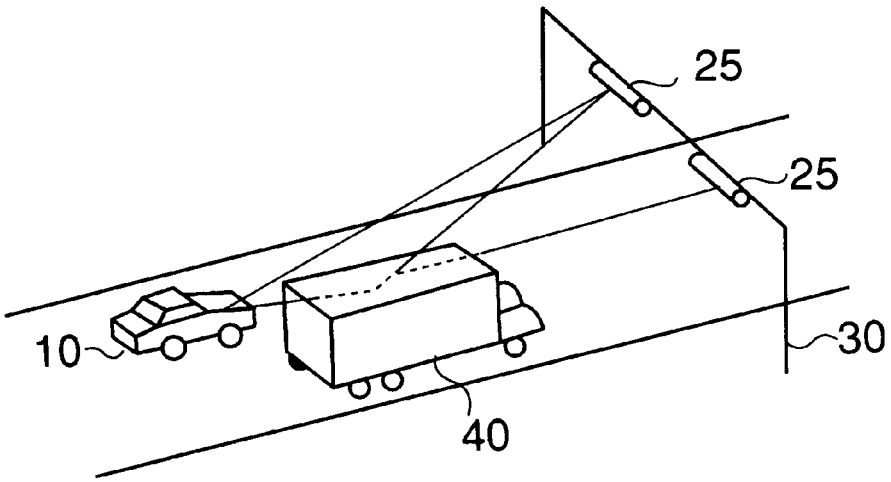
FIG. 4B is a diagram for illustrating an example of inaccurate measurement of direction by means of a vehicle identification system applying the one dimensional interferometry principle.

However, the vehicle identification system by way of one dimensional interferometry principle tracks the locus of a vehicle by measuring one-dimensionally only the DOA of radio wave transmitted from the vehicle. When a small vehicle 10 such as a passenger car moves side by side in parallel with a large vehicle 40 such as a trailer or a bus as shown in FIG. 4B, radio wave from the vehicle 10 is blocked by the large vehicle 40 and does not arrive at the antenna 25 (this condition is referred to as shadowing). It is sometimes difficult to measure the location of a vehicle 10 in the case that the location is measured only by way of the DOA.

In this case, though the location of a vehicle is measured based on the intersection of a pair of directional lines from a pair of antennas 25 as shown in FIG. 3A, in the one dimensional interferometry principle, the intersection of directional lines is not deviate from the true position because of insufficient information in vertical direction due to depression angle, this insufficient information adversely affects the location error.

Now, a vehicle identification system in accordance with the preferred embodiment of the present invention will be described as follows.

Figure 5:
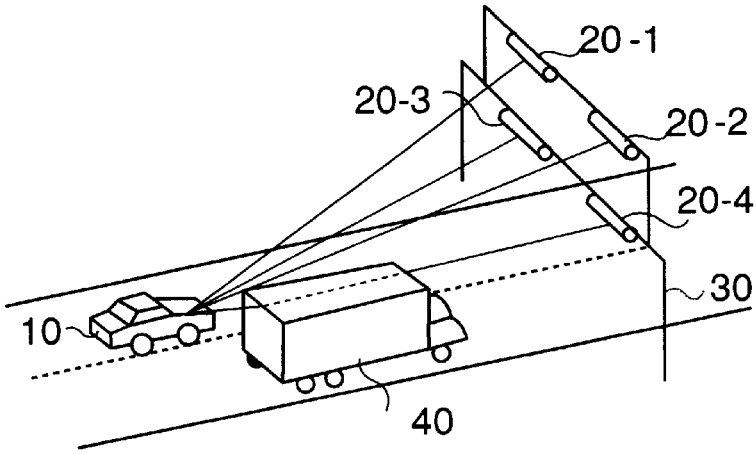
FIG. 5 is a perspective view for illustrating the structure of a vehicle identification system of an embodiment applying the two dimensional interferometry principle in accordance with the present invention.
Figure 6A:
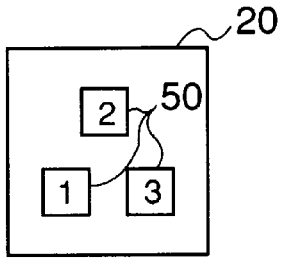
FIG. 6A is a diagram for illustrating the structure of a antenna shown in FIG. 5.
Figure 6B:
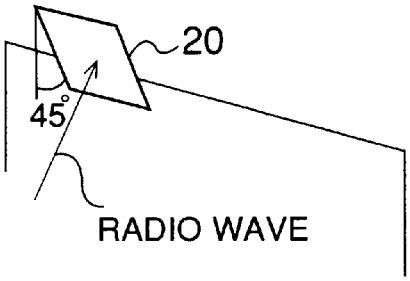
FIG. 6B is a diagram for illustrating the set angle of the antenna shown in FIG. 5.

In a vehicle identification system in accordance with the preferred embodiment of the present invention, a plurality of antennas 20 is deployed not only in horizontal direction but also in vertical direction as shown in FIG. 5. The directional angle and depression angle of arrival radio wave from the vehicle are measured two-dimensionally. In other words, the location of a vehicle is measured by way of two dimensional interferometry principle. At least two antennas 20 out of a plurality of antennas deployed in horizontal direction and vertical direction are selected as the antennas used for measurement of the directional angle and depression angle. The location of a vehicle in the vertical plane and horizontal plane is measured based on the information obtained from the selected antennas 20. An array antenna comprising at least three antenna elements 50 as shown in FIG. 6A is used as the antenna 20. The antenna 20 is installed with a depression angle of about 45 degrees toward the road to increase the radio wave sensitivity and range of measurement as shown in FIG. 6B.

Next, a method for determining the directional angle and depression angle of arriving radio wave from a vehicle by way of two dimensional interferometry principle is described hereinafter.

In the two dimensional interferometry principle like one dimensional interferometry principle, n antenna elements 50 to which the element numbers from 1 to n are given respectively are used. Signals outputted from each antenna element 50 are represented by X1, X2, X3, . . . , Xn, wherein the numbers represent the element number respectively. Antenna elements 50 are paired to form pairs, and the phase difference $\psi_{ij}$ of each pair is represented by the above-mentioned equation (1). The theoretical value (or measured value) of a signal to be outputted from each antenna element 50 is determined previously for all the directional angle θ and depression angle ψ, and these values are stored in a memory device. The theoretical value (or measured value) is represented by A1(ϕ, θ), A2(ϕ, θ), A3(ϕ, θ), . . ., An(ϕ, θ) corresponding to the element number given to each antenna element 50.

Like the equation (1), the phase difference of each pair is represented by the following equation (4).

$$A_{ij}(\phi, \theta) = \frac{\overline{A_i(\phi, \theta)A_j^*(\phi, \theta)}}{|\overline{A_i(\phi, \theta)A_j^*(\phi, \theta)}|} \tag{4}$$

The standard phase $A_{ij}(\phi, \theta)$ represented by the equation (4) is determined previously for all the directional angle ϕ and depression angle θ. The directional angle ϕ and depression angle θ at which the phase difference $\psi_{ij}$ represented by the equation (1) becomes nearest the standard phase difference $A_{ij}(\phi, \theta)$ represented by the equation (4) is determined. The determined directional angle ϕ and depression angle θ are estimated to be a DOA of radio wave from a vehicle. The least square method is used for estimation of the DOA. That is, the DOA ϕ and θ at which the equation (5) becomes the minimum are determined.

$$\sum_{ij}\left(\frac{\overline{X_i X_j^*}}{|\overline{X_i X_j^*}|} - \frac{\overline{A_i(\phi, \theta)A_j^*(\phi, \theta)}}{|\overline{A_i(\phi, \theta)A_j^*(\phi, \theta)}|}\right) \tag{5}$$

Next, a method for determining the location of a vehicle based on the DOA of radio wave from the vehicle as described herein above is described hereinafter.

Figure 7:
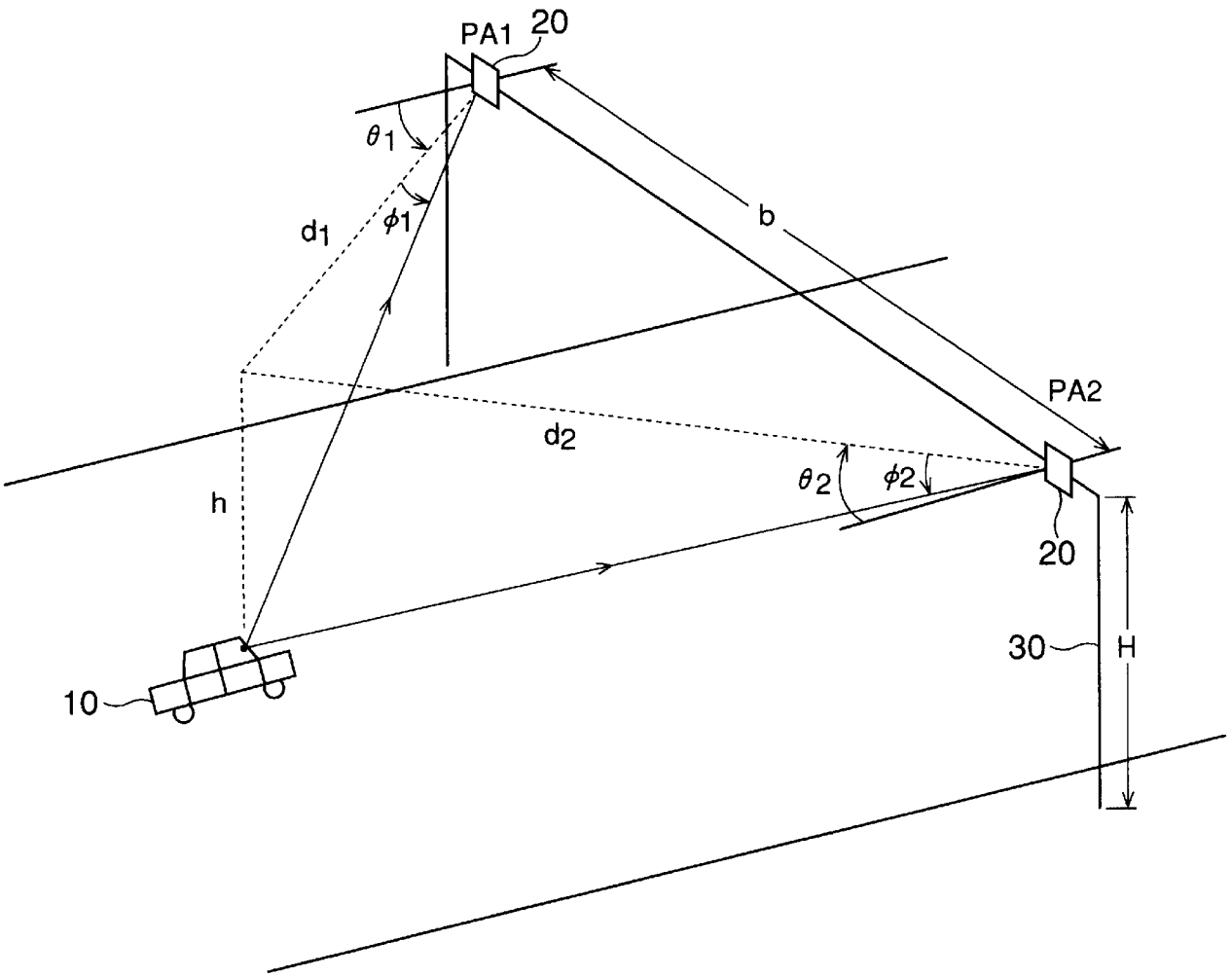
FIG. 7 is a perspective view for describing the location measurement method of a vehicle applying the two dimensional interferometry principle in the embodiment in accordance with the present invention.

In the case that two antennas 20 are used for measuring the DOA of radio wave as shown in FIG. 7, the DOA (ϕ1, θ1 ) and (ϕ2 and θ2) of radio wave is determined. In FIG. 7, PA1 and PA2 are plane antennas, θ1 and θ2 are directional angles of arriving radio wave, ϕ1 and ϕ2 are depression angles of arriving radio wave, b is a base line length namely a distance between PA1 and PA2, d1 and d2 are horizontal distances from a vehicle 10 to each antenna 20, h is a height from the vehicle 10 to the gantry 30, and H is the height of the gantry 30 to be installed. The installation height of the transceiver equipped with the vehicle from the ground is H-h.

Figure 8:
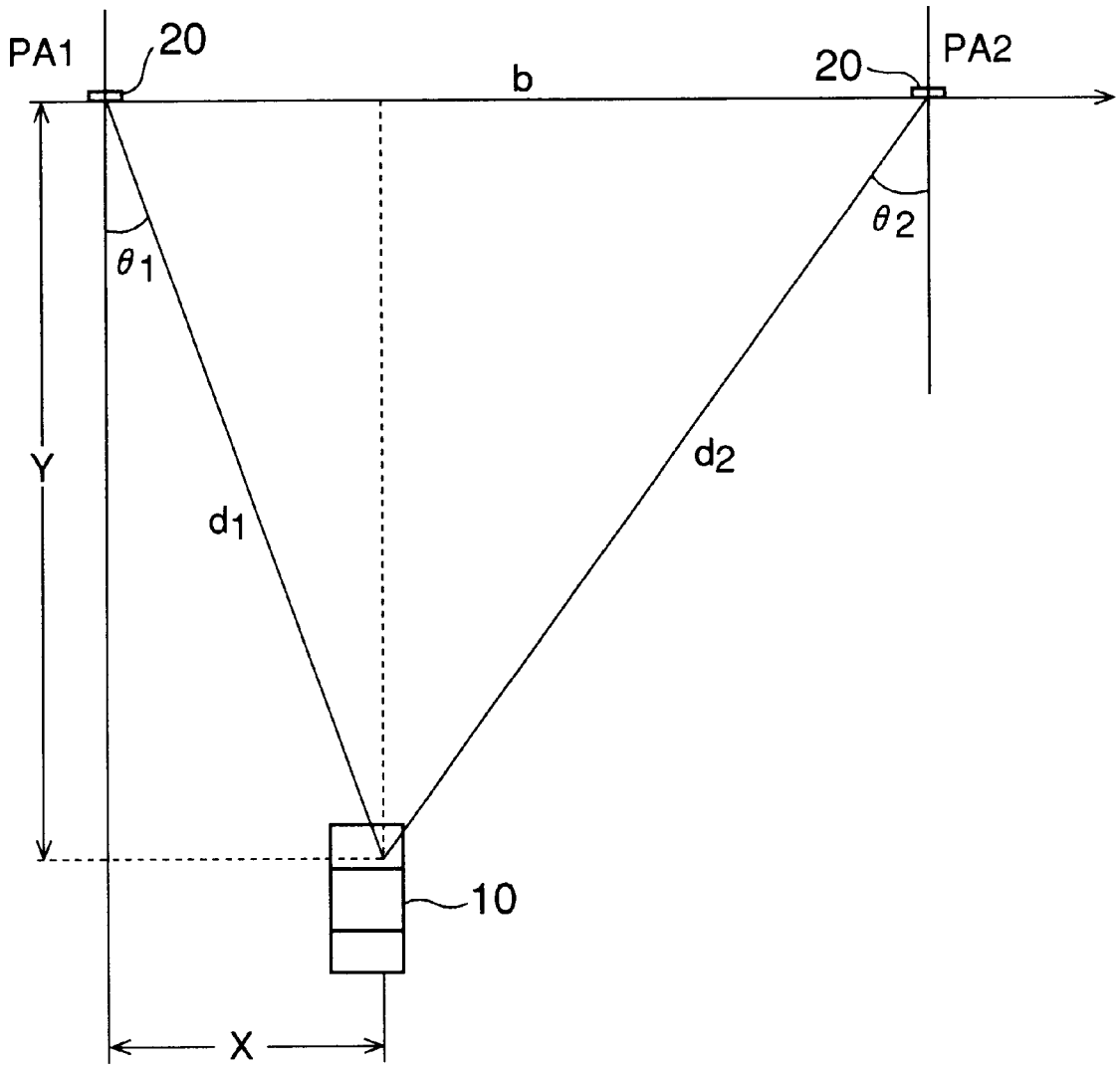
FIG. 8 is a plan view for describing the on-plane location measurement method of a vehicle applying the two dimensional interferometry principle in the embodiment in accordance with the present invention.

The location on the horizontal plane of the vehicle 10 which is transmitting radio wave is represented by coordinates X and Y having the origin at the location of the antenna 20 as shown in FIG. 8. The location X and Y of the vehicle 10 on the horizontal plane is determined by way of the following equations (6) to (10) using the measured DOA (directional angle and depression angle) of radio wave and the known base line length.

$$d_1 = \frac{b\cos\theta_2}{\sin(\theta_1 + \theta_2)} \tag{6}$$

-continued $$d_2 = \frac{b\cos\theta_1}{\sin(\theta_1 + \theta_2)} \tag{7}$$

$$h = d_1\tan\phi_1 = d_2\tan\phi_2 \tag{8}$$

$$X = d_1\sin\theta_1 \tag{9}$$

$$Y = d_1\cos\theta_1 \tag{10}$$

Further, for measurement of the location of the vehicle 10, at least two antennas which are estimated to be positioned at the place where the antennas can receive radio wave from the vehicle without blocking of radio wave by a large vehicle 40 are selected out of a plurality of antennas deployed. Alternately, the locus of the DOA of radio wave measured for each antenna are traced, and most suitable antennas 20 are selected, that is, antennas deviated significantly from the average locus are not selected.

In this embodiment, because the directional angle and depression angle of arriving radio wave are measured by way of two dimensional interferometry principle, it is possible to deploy antennas 20 not only in horizontal direction but also in vertical direction. When the location of a vehicle which is transmitting radio wave is measured, the optimal combination of antennas 20 which receive radio wave without blocking by a large vehicle is selected, and thus the adverse effect of shadowing is suppressed. In FIG. 5, combinations of antennas such as antenna 20-1 and antenna 20-2, and antenna 20-1 and antenna 20-3 corresponds such optimal combination.

The location of a vehicle is calculated both for the horizontal plane and vertical plane based on the directional angle and depression angle of arriving radio wave from the vehicle, the location of the vehicle is measured therefore more accurately.

Next, a vehicle identification system of the embodiment of the present invention to which the above-mentioned method for measuring the location of a vehicle is applied is described referring to the drawings. In particular, an embodiment in which the vehicle identification system is applied to collect toll on a highway, for example, is described.

Figure 9:
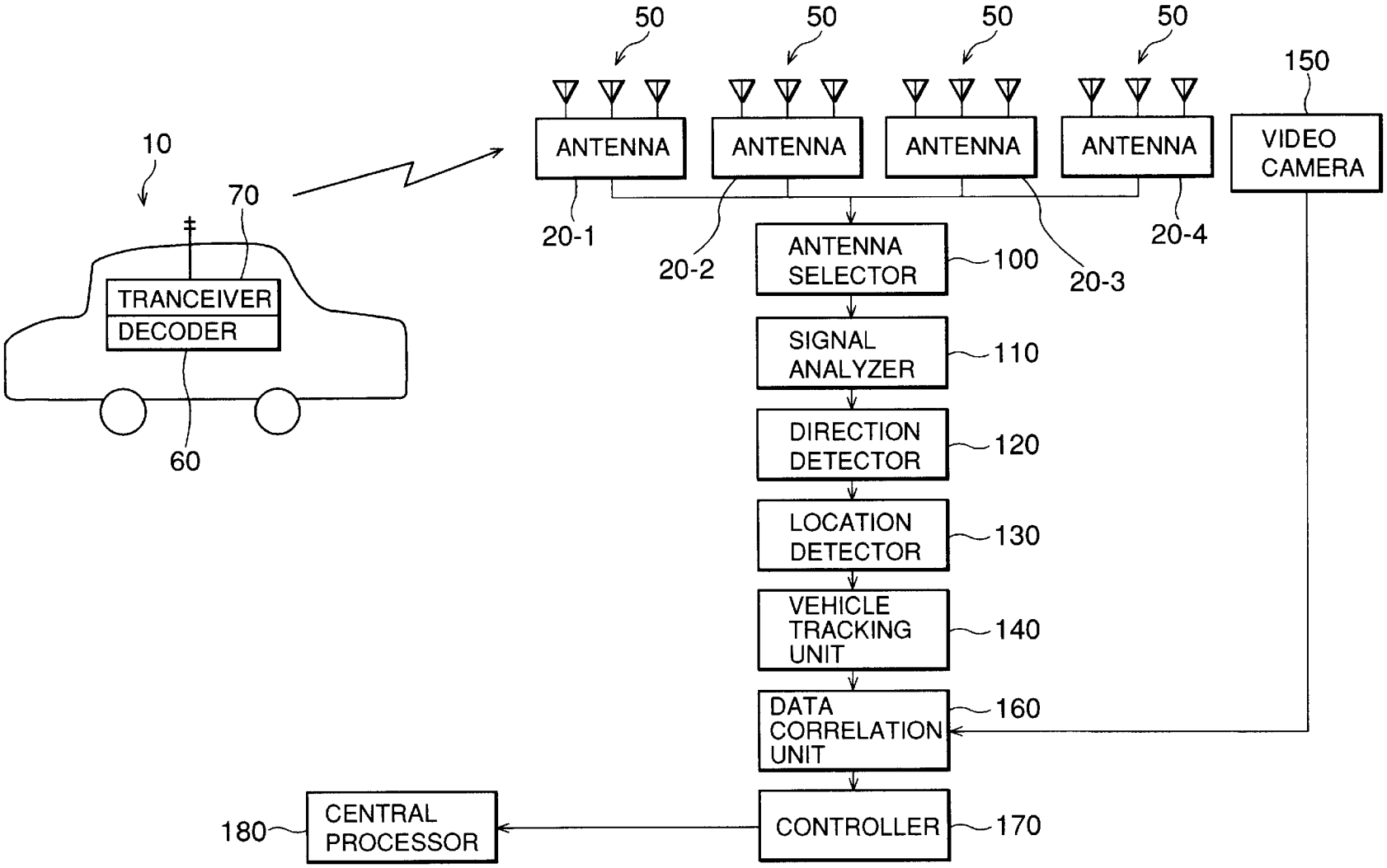
FIG. 9 is a schematic diagram for illustrating the structure of a vehicle identification system of the embodiment in accordance with the present invention.
Figure 10:
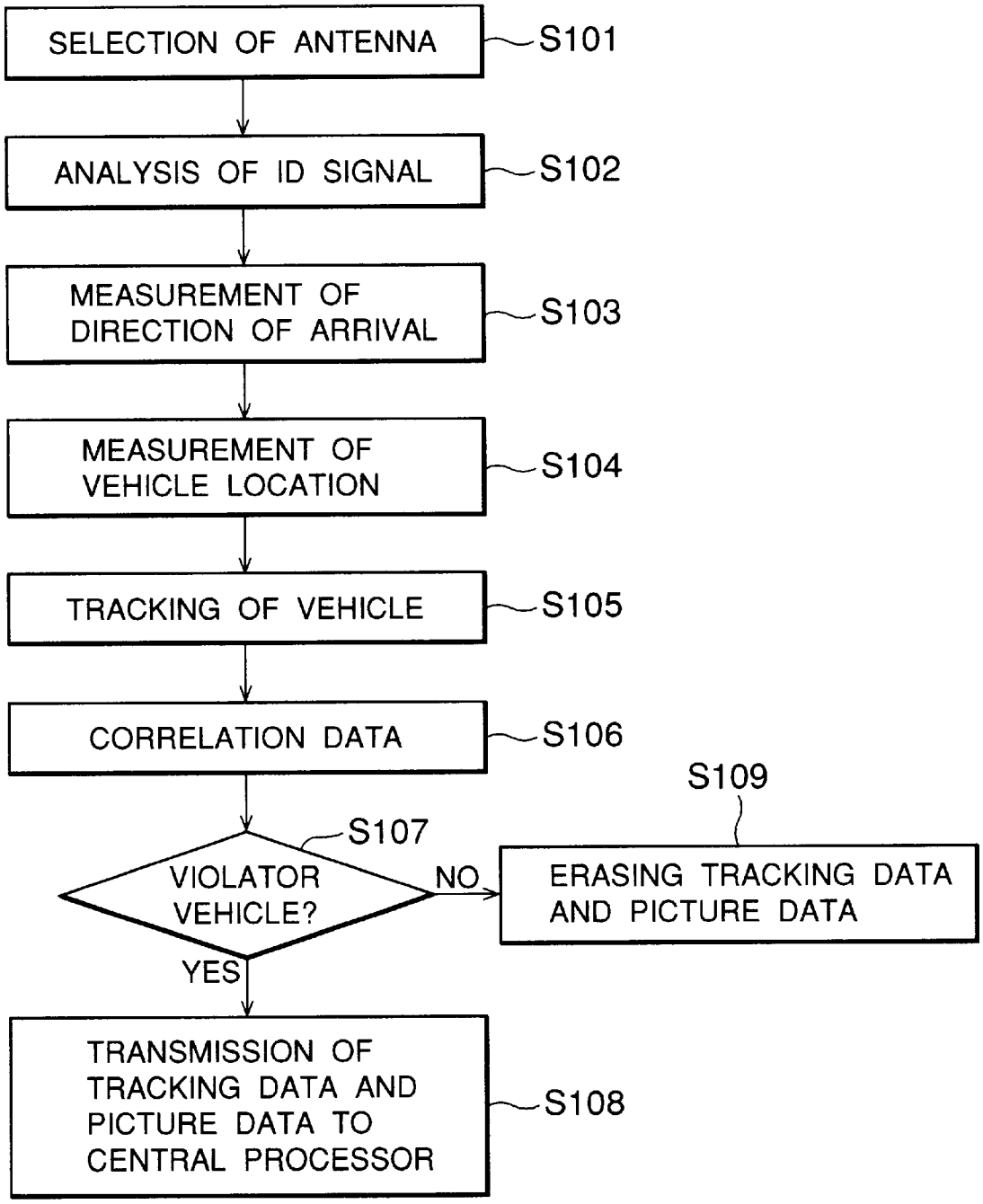
FIG. 10 is a flow chart for describing the processing sequence in the vehicle identification system shown in FIG. 9.

In FIG. 9, a vehicle 10 is provided with an IC card decoder 60 for analyzing an IC card on which information for identifying the vehicle is recorded and a transceiver 70 for transmitting an ID code signal analyzed by the decoder 60 by way of radio wave. In the IC card, the information such as the vehicle number, name of owner of the vehicle, and specified bank account number is recorded previously. On the other hand, in the vehicle identification system, at least four antennas 20 disposed in horizontal and vertical direction namely two dimensionally as shown in FIG. 4A, each antenna has at least three antenna elements 50 as shown in FIG. 6A, and receives the ID code signal transmitted from the vehicle 10. In detail, when the vehicle 10 comes in the toll collection area of a toll road such as a highway, the plurality of antennas 20 receives radio wave (ID code signal) including the ID code transmitted from the transceiver 70 of the vehicle 10.

The location of the vehicle 10 which transmitted radio wave is measured using the radio wave received by two antennas 20 which are selected by an antenna selector 100. The antenna selector 100 selects at least two antennas which are estimated to receive sufficiently radio wave from the vehicle without blocking of radio wave by a large vehicle as described hereinbefore. Alternately, the antenna selector 100 traces the locus of the DOA of radio wave measured by each antenna 20, rejects antennas with significant deviation from the average locus, and selects at least two optimal antennas 20 (S101).

The radio wave namely ID code signal received by two antennas 20 selected by the antenna selector 100 is analyzed by a signal analyzer 110, and the vehicle 10 which transmitted the ID code signal is specified based on the analysis result of the signal analyzer 110 (S102).

Next, the directional angle θ and depression angle φ namely the DOA of the radio wave received by the antennas 20 are determined by a direction detector (directional finder) 120 (S103). Assuming that the antenna selector 100 selects the antennas 20-1 and 20-2 shown in FIG. 5, the directional angle and depression angle of the arriving radio wave received by the antennas 20-1 and 20-2, namely (φ1, θ1) and (φ2, θ2) shown in FIG. 7, are determined as the DOA by the direction detector 120. A location detector 130 calculates the location of the vehicle 10 both on the horizontal plane and vertical plane based on the DOA measured by the direction detector 120 (S104). The processing performed by the direction detector 120 and location detector 130 is operated by way of two dimensional interferometry principle. The size of the vehicle 10 may be estimated based on the height information of the vehicle 10 calculated by the location detector 130.

A vehicle tracking unit 140 stores correspondingly a locus data of the vehicle 10 obtained by tracking the location data of the vehicle 10 obtained by the location detector 130 and the ID data for identifying the vehicle 10 obtained by the signal analyzer 110 in a memory device not shown in the figure. In other words, the movement of the vehicle 10 is tracked by the vehicle tracking unit 140 (S105). The tracking processing by the vehicle tracking unit 140 is realized by storing successively location data in the memory device while location data of the vehicle 10 obtained every certain time interval from the location detector 130 are correlated for each location change by way of correlation processing.

Simultaneously with the processing for acquiring the locus data of the vehicle 10 described herein above, a video camera 150 that is a picture data collection means takes a picture of the toll collection area, and the picture data which includes the picture of the vehicle 10 which is coming in the area is collected. A data correlating unit 160 correlates the locus data of the vehicle 10 supplied from the vehicle tracking unit 140 with the picture data supplied from the video camera 150 (S106). In detail, the vehicle number that is the information for specifying the vehicle 10 included in the locus data is correlated with the vehicle number obtained from the picture taken by the video camera 150. The identification whether the vehicle 10 which had the IC card and transmitted the ID code signal is exactly the same as the vehicle 10 on the picture taken by the video camera 150 is judged.

The data correlation unit 160 supplies the correlation result and locus data including the ID for specifying the vehicle 10 to a controller 170. The controller 170 collects automatically a prescribed toll from the vehicle 10 which comes in the toll collection area based on the data supplied from the data correlation unit 160. The toll is collected by automatic withdrawing of the prescribed amount for the toll from the specified bank account registered in the IC card. At the same time, the controller 170 judges whether the vehicle 10 is a violator vehicle based on the locus data supplied from the data correlation unit 160 (S107). If the data correlation unit 160 finds an incomplete or unjust ID data, or conflict between the vehicle number included in the ID data and the vehicle number on the picture taken by the video camera 150, the controller 170 judges the vehicle 10 to be a violator vehicle.

When the controller 170 determines the vehicle 10 to be a violator vehicle, the controller 170 sends the data of the vehicle 10 namely the locus data acquired by the vehicle tracking unit 140 and picture data acquired by the video camera 150 to the central controller 180 for registering (S108). For the vehicle 10 registered as a violator vehicle in the central controller 180, the vehicle and owner of the vehicle are specified based on the locus and picture data, and a prescribed toll is collected later.

On the other hand, the data of the vehicle 10 which is judged not to be a violator vehicle by the controller 170 and from which a prescribed toll is collected, namely the locus data and picture data, is erased (S109).

The controller 170 controls the antenna selector 100, signal analyzer 110, direction detector 120, location detector 130, vehicle tracking unit 140, and data correlation unit 160 at desired timing.

According to the present invention, since the DOA of radio wave transmitted from a vehicle is measured two-dimensionally based on the directional angle and depression angle, the vehicle location is measured both on the horizontal plane and vertical plane. The location of a vehicle which comes in the certain area is detected accurately. In particular, the adverse effect of shadowing can be suppressed, and therefore miss detection of a vehicle is prevented.

In the location measurement by way of two dimensional interferometry principle, antennas can be disposed not only in the horizontal direction but also in the vertical direction, and the optimal antennas can be selected so that the adverse blocking effect of radio wave by a large vehicle such as a trailer or a bus is eliminated.

Further, the size of a vehicle may be estimated based on the height information of the vehicle, and thus the vehicle is detected and identified easily.

It is apparent that the present invention is not limited to the above embodiment but may be modified and changed without departing from the scope and spirit of the present invention.

What is claimed is:

1. A system for identifying a vehicle which comes into a prescribed area, comprising:

receiving means for receiving a radio wave transmitted from a vehicle which comes into a prescribed area, said receiving means comprising a plurality of antennas;

a selector for selecting at least two antennas from said plurality of antennas which receive said radio wave from the vehicle not blocked by a larger vehicle;

identification means for identifying said vehicle based on an identification signal included in said radio wave which is received by said receiving means:

a directional finder for measuring a direction of arrival of said radio wave received by said at least two antennas selected by said selector; and location detection means for calculating a location of said vehicle based on the direction of arrival measured by said directional finder.

2. The system as claimed in claim 1, wherein said receiving means comprises a plurality of antennas, each antenna having at least three antenna elements, and wherein said directional finder comprises means for measuring a directional angle and depression angle of said radio wave to each said antenna based on a phase difference of said radio wave received by two of said antenna elements included in said respective antennas and a previously registered standard phase difference.

3. The system as claimed in claim 2, wherein said location detection means determines an intersection of direction lines formed from each said antenna as the location of said vehicle in a horizontal direction, said direction lines formed in the direction of arrival of said radio wave received by said respective antennas from said respective antennas.

4. The system as claimed in claim 2, wherein ones of said plurality of antennas are disposed in a horizontal direction and ones of said plurality of antennas are disposed in a vertical direction.

5. The system as claimed in claim 2, wherein said plurality of antennas comprises at least two antennas disposed in a horizontal direction and at least two antennas disposed in a vertical direction.

6. The system as claimed in claim 2, wherein at least one of said plurality of antennas disposed with its radio wave receiving plane facing in an inclined depressing direction.

7. The system as claimed in claim 1, further comprising:

vehicle tracking means for determining the locus of said vehicle based on the location of said vehicle measured by location detection means.

8. The system as claimed in claim 1, further comprising:

camera means for taking a picture of said vehicle which comes into said prescribed area.

9. The system as claimed in claim 7, further comprising:

camera means for taking a picture of said vehicle which comes into said prescribed area and outputting a picture data; and means for identifying said vehicle by correlating said picture data supplied from said camera means with the locus of said vehicle determined by said vehicle tracking means.

10. The system as claimed in claim 1, wherein said directional finder measures a direction of arrival of said radio wave transmitted from said vehicle by way of two dimensional interferometry in terms of a directional angle and depression angle.

11. The system as claimed in claim 10, wherein said location detection means calculates the location of said vehicle on the horizontal plane and the height in the vertical direction based on the directional angle and depression angle of the direction of arrival of the radio wave measured by said directional finder.

12. A system for identifying a vehicle which comes into a collection area and for collecting a prescribed toll from said vehicle, comprising;

receiving means for receiving a radio wave transmitted from a vehicle which comes into a toll collection area, Wi receiving means comprising a plurality of antennas;

a selector for selecting at least two of said plurality of antennas which receive the radio wave from the vehicle not blocked by a larger vehicle;

identification means for identifying said vehicle by analyzing an identification signal included in said received radio wave;

a directional finder for measuring a direction of arrival of said radio wave;

location detection means for calculating the location of said vehicle based on the direction of arrival measured by said directional finder;

vehicle tracking means for calculating the locus of said vehicle based on an identification information of said vehicle outputted from said identification means and a location information of said vehicle outputted from said location detection means, and outputting locus data indicative of the locus of said vehicle;

camera means for taking a picture of said vehicle and outputting a picture data; and toll collection means for collecting a desired toll from said vehicle based on the locus data outputted from said vehicle tracking means and the picture data outputted from said camera means.

13. The system as claimed in claim 12, further comprising:

correlation means for correlating said locus data with the said picture data; and judging means for judging whether said vehicle is a violator vehicle based on correlation result generated by said correlation means.

14. The system as claimed in claim 13, further comprising:

means for registering the locus data and picture data of said vehicle when said vehicle is judged to be a violator vehicle.

15. The system as claimed in claim 12, further comprising:

means for erasing the locus data and picture data of said vehicle when said vehicle is judged not to be a violator vehicle.

16. The system as claimed in claim 12, wherein said receiving means is provided with a plurality of antennas each having at least three antenna elements, and wherein said directional finder is provided with means for measuring the direction of arrival of said radio wave to each antenna based on phase difference of said radio wave received by two of said two antenna elements included in said respective antennas and a previously registered standard phase difference.

17. The system as claimed in claim 12, wherein said directional finder measures the direction of arrival of radio wave transmitted from said vehicle with two dimensional interferometry in terms of the directional angle and depression angle.

18. The system as claimed in claim 12, wherein said location detection means calculates the location of said vehicle on the horizontal plane and the height in the vertical direction based on the directional angle and depression angle of the direction of arrival of the radio wave measured by said directional finder.

19. The system as claimed in claim 14, wherein said correlation means comprises means for correlating vehicle number information of said vehicle included in said ID signal with vehicle number information on the picture taken by said camera means.

* * * * *